United States Patent [19]

Schäfer

[11] Patent Number: 4,676,384

[45] Date of Patent: Jun. 30, 1987

[54] SHELF BOARD OF LAMINATED MATERIAL, PARTICULARLY SHEET METAL

[75] Inventor: Gerhard Schäfer, Neunkirchen-Salchendorf, Fed. Rep. of Germany

[73] Assignee: Fritz Schäfer Gesellschaft mit Beschränkter Haftung, Neunkirchen, Fed. Rep. of Germany

[21] Appl. No.: 683,570

[22] Filed: Dec. 19, 1984

[30] Foreign Application Priority Data

Dec. 22, 1983 [DE] Fed. Rep. of Germany ... 8336766[U]

[51] Int. Cl.[4] ..... A47F 5/00

[52] U.S. Cl. ..... 211/184; 108/60

[58] Field of Search ..... 211/184, 189, 153; 108/61, 60

[56] References Cited

U.S. PATENT DOCUMENTS

| | | | |
|---|---|---|---|
| 1,046,488 | 12/1912 | Pauley | 211/184 X |
| 1,165,703 | 12/1915 | O'Connor | 108/61 |
| 1,227,703 | 5/1917 | Ulrich | 108/61 |
| 1,231,005 | 6/1917 | Erickson | 211/184 |
| 1,480,345 | 1/1924 | Bradley | 108/60 |
| 1,829,588 | 10/1931 | Forsyth | 211/184 |
| 1,853,840 | 4/1932 | Bailey | 211/153 |
| 2,026,223 | 12/1935 | Donnelly | 108/60 |
| 2,374,658 | 5/1945 | Bales | 211/153 |
| 3,684,103 | 8/1972 | Bellinder | 211/189 |
| 3,881,428 | 5/1975 | Klecki | 108/60 X |
| 4,308,963 | 1/1982 | Worrallo | 211/153 |
| 4,535,898 | 8/1985 | Jones et al. | 211/153 |

*Primary Examiner*—Ramon S. Britts
*Assistant Examiner*—Sarah A. Lechok Eley
*Attorney, Agent, or Firm*—Toren, McGeady & Associates

[57] ABSTRACT

A shelf board (3) formed of a plate-like material, particularly sheet metal, exhibits by way of a stiffening profile (6) a tubular cross-section at least along one of the longitudinal edges. To improve the torsional or twisting deformation resistance and thus achieve a higher load carrying capacity, the tubular cross-section of the stiffening profile (6) is equipped at least at its inside bottom surface with a stepped recess profile section (15) formed by a step-shaped bend (11, 12).

8 Claims, 3 Drawing Figures

SHELF BOARD OF LAMINATED MATERIAL, PARTICULARLY SHEET METAL

The present invention is directed to a shelf board from laminated or plate-like material, particularly sheet metal, with stiffening profiles formed by bending at the bottom side of its longitudinal and transverse edges, whereby at least the stiffening profile at one of the longitudinal edges is at least shaped as a nearly closed tubular cross-section, while the stiffening profiles of both transverse edges have an angle- or C-shaped cross-section.

Shelf board of this sort has already become known through the DE-GM No. 630 741. Hereby not only the high load carrying capacity is advantageous, but also the good safety against injury to persons or damage to objects, since there are no sharp edges. Also the connection with the shelf posts can be made without special corner fittings being required, so that the shelf board can be attached in an easily convertible way and thereby, particularly in its corner areas, exhibits a high design strength, which enables a direct connection to be made from post to post by means of the shelf board, because it acts as a belt.

A further embodiment of such a shelf board is known through the DE-OS No. 31 24 922. Here at least the front longitudinal edge stiffening profile is formed by two tubular cross-sections spaced apart and parallel to each other, which together form a trough profile open towards the bottom, whose spaced apart walls are at the same time legs of the trough profile piece.

This known embodiment of a shelf board conforming to this type resists not only the occurrence of torsional- or twisting deformation at the longitudinal edge-stiffening profiles, but also additionally a further increase in the load carrying capacity results.

The advantages obtainable by the embodiment according to DE-OS No. 31 24 922 as against the DE-GM No. 7 630 741 however assume a not inconsiderable increase in material expenditure, because namely the formation of the twin tube cross-section necessarily requires correspondingly increased partition lengths in cross-sectional direction.

It is the objective of the present invention to remove the shortcomings of the known shelf boards. Therefore the novelty is based on the task to create a shelf board of the sort conforming to type which, without an increase in material expenditure, can withstand higher torsional- or twisting deformations in the area of the longitudinal edge-stiffening profile and also achieves a higher load carrying capacity.

The solution of this task is achieved in a novel way in that the tubular cross-section of the stiffening profile is provided at least at its lower, inside located longitudinal edge with a recessed profile section constriction consisting of a step-shaped bend.

The advantage of this embodiment as against that according to DE-GM No. 7 630 741 consists in that, in the area of the longitudinal-stiffening profile an increased torsional rigidity and load carrying capacity is achieved, without an increased expenditure of material being required.

In a further refinement of the present invention it has proved successful, if the step-shaped bend forming the recessed profile section extends at least over a third of the tubular cross-section width and the tubular cross-section height. It has indeed been shown that with such a refinement of the longitudinal edge-stiffening profiles particularly favorable values with reference to the torsional rigidity and load carrying capacity of the shelf board were achieved.

In the shelf board according to DE-GM No. 7 630 741 respectively its one wall of the longitudinal edge-stiffening profiles forming the edge zones of the bottom face as well as the parallel thereto bent over section of same are provided with one each punched out slit and/or hole detent and thereby both slit and/or hole detents register with each other. These slit and/or hole detents, which normally extend uniformly along the longitudinal edges of the shelf board, are used in order to subdivide in case of necessity the shelf compartments formed by the shelf boards lying one above the other, through insertion of vertical partitions, whereby these partitions are interlockable with detent blades, lugs and/or pins into the detent slits and/or holes of the shelf boards and the stiffening profiles.

The novel shelf board can also be designed in a corresponding manner with the objective subdividing of shelf compartments by vertical partitions. A particularly important feature of the present invention is seen here in that the detent slits and/or holes in the shelf board face and the stiffening profile located below lie in an area which at least partially overlaps into the step-shaped bend of the profile constriction.

These measures, in an especially advantageous way, permit, in particular, the detent blades, lugs and/or pins located at the lower edges of the partitions to act together with the detent blades and/or holes of a shelf board and its longitudinal stiffening profile in two detent faces spaced one above the other, without that thereby the free end of the detent blades, lugs and/or pins extend beyond the lower boundary edge of the longitudinal edge stiffening profiles. The disadvantages proper to the arrangement according to the DE-GM No. 1 881 677, namely that the free ends of the blade, lug and/or pins protruding from the bottom and liable to cause injuries, are hereby effectively avoided.

A particularly expedient refinement of these measures is achieved in that the detent slits extend over an approximately Z-shaped profile area of the step-shaped bend in the stiffening profile. Thereby namely in a manner of speaking three insertion faces spaced one above the other result in the area of each longitudinal edge-stiffening profile, of which the two upper insertion faces serve for receiving the detent blades, -lugs and/or pins located at the lower edge of the vertical partitions, while the lower insertion face is suited at the same time, to receive detent blades, lugs and/or pins, which are located at the upper edge of a vertical partition, which rests on the next lower shelf board.

It has been provided in a novel manner, that the free length of the detent blades, lugs and/or pins at the partitions is dimensioned to be smaller than the maximum cross-sectional heights of the longitudinal edge-stiffening profile. It is thereby particularly important that the free length of the detent blades, lugs and/or pins located at the lower edge of the partitions is dimensioned to be larger than the cross-sectional height of the longitudinal edge-stiffening profile in the area of its recessed profile section formed by the step-shaped bend.

The present invention does not only enable the use of vertical partitions, which are attached by means of detent blades, lugs and/or pins in two shelf boards spaced one above the other, rather the measures proposed are suited in a particularly advantageous way to be used during construction of such shelves, in which the shelf compartments formed in between shelf boards located one above the other are subdivided only through self-supporting partitions so-called dividers. Such self-supporting dividers are fixed upon the shelf supporting them merely at their lower edges by means of detent blades, lugs and/or pins, while their upper edges are spaced more or less away from the next upper shelf board.

The partitions designed as so-called dividers can also be assembled from several equally constructed or identical partition-partial pieces, which are couplable with each other by means of detent blades, lugs and/or pins insertable into pockets. Hereby it has been shown to be particularly advantageous, if the partition partial pieces are designed as parts molded from synthetic material, in which the pockets for receiving of the detent blades, lugs and/or pins are located at the upper and lower edge. Each of the partition-partial pieces can be provided in the area of their upper edges additionally with molded-in insert guides for receiving of marking carriers or labels.

The subject of the novelty is presented in the drawing with the help of an embodiment example. It is shown on FIG. 1 is a schematic front elevational view of a shelf construction with shelf boards in accordance with the present invention, whereby vertical partitions are inserted;

Figure 1:
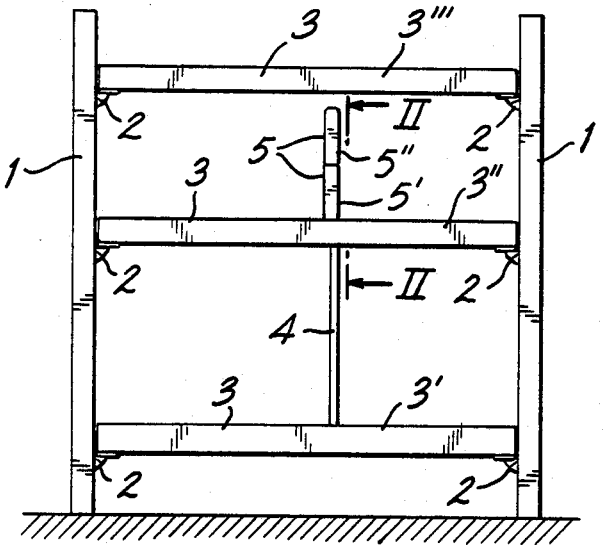

The shelf shown in FIG. 1 has several, namely at least four, identical shelf posts 1, which are provided at least on the inner side with support and/or coupling elements 2 for the shelf boards 3. The support and/or coupling elements 2 can here, for instance, consist of detent-like stamped out blades at a uniform distance above each other and hole detents can also be provided in the shelf post 1, into which angular rails can possibly be hooked as supports for the shelf boards 3.

According to FIG. 1, three shelf boards 3 are hooked, spaced one above the other, between the shelf posts 1. A vertical partition 4 extending over the entire height of the shelf compartment is provided between the lower shelf board 3' and the middle one 3'', while a vertical partition 5 is provided between the middle shelf board 3'' and the upper shelf board 3''', which as a so-called divider does not extend over the entire height of the shelf compartment concerned, but rather ends at a distance below the upper shelf board 3''.

The partition 5 provided as a so-called divider, is assembled from several, for instance two, similarly constructed or at least identical partition-partial pieces 5' and 5'', in such a way that it can be adapted to diverse heights of the shelf compartments.

Figure 2:
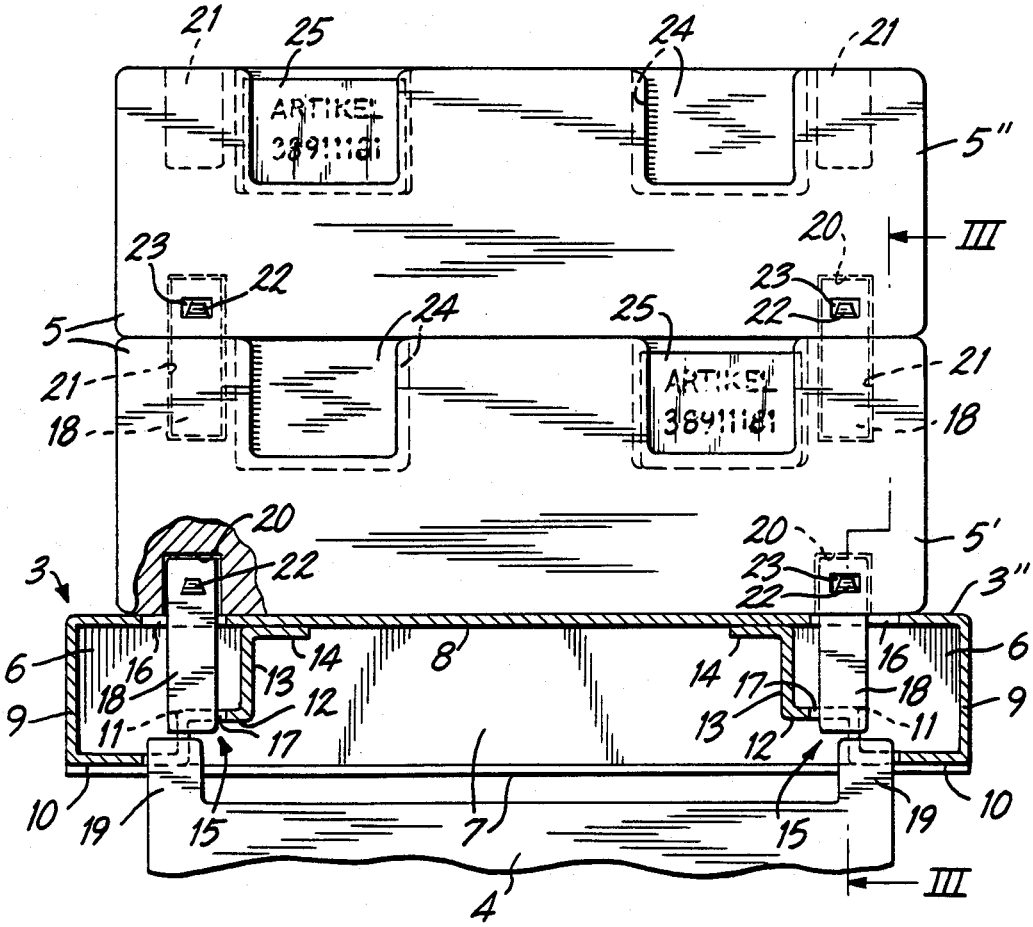
FIG. 2 is a view partly in cross-section taken along the line II—II in FIG. 1 on an enlarged scale.

It can be learned from FIG. 2 in the example of the shelf board 3'', that the respective shelf boards exhibit stiffening profiles 6 along their longitudinal edges and have also stiffening profiles 7 at their transverse edges.

The shelf boards 3 together with their stiffening profiles 6 and 7 consist of laminated or plate-like material, particularly sheet metal, whereby the stiffening profiles 6 and 7 are respectively formed directly out of the laminated material by multiple bending.

While the longitudinal edge-stiffening profiles 6 of the shelf board 3 are formed by means of bending into an at least almost, and preferably completely closed, tubular cross-sections, it suffices for the transverse edge-stiffening profiles 7 as a rule, if they are formed into an angle-shaped or C-shaped cross-section by bending.

The longitudinal edge-stiffening profiles 6 have respectively a bent over section 9 directed at right angles to the actual shelf board face or support surface 8, which is, again at right angles, adjoined by a bent over section 10, which therefore is directed parallel to the shelf board face 8. A bent over section 11 follows hereto at right angles, whereby said section again extends parallel to the bent over section 9. It has hereby a length corresponding approximately to a third of the length of the bent over section 9. A bent over section 12 again extends in one piece and at right angles from the bent over section 11, which therefore extends also parallel to the shelf board face 8 and to the bent over section 10. The bent over section 11 has thereby a length, which is dimensioned to be approximately half as long, as the length of the bent over section 10.

A bent over section 13 extends again at right angles from the bent over section 12 and thus parallel to the bent over sections 9 and 11, which section 13 extends until approximately the bottom side of the shelf board face 8 and which ends there in a leg 14 bent over parallel to the shelf board face 8. The leg 14 of the longitudinal edge-stiffening profile 6 can thereby be solidly fastened with the shelf board 8, for instance through the application of a sufficient quantity of point welds.

The tubular cross-section of the longitudinal edge-stiffening profile 6 of the shelf boards exhibits a step-shaped profile constriction 15 through the special arrangement of the two bent over sections 11 and 12 at its lower located inside longitudinal edge, which leads to the longitudinal edge-stiffening profiles 6 having an increased torsional rigidity and their permitting an increased load carrying capacity of the shelf board 3. A refinement of the longitudinal edge-stiffening profile 6 has hereby proved to be particularly successful, in which the step-shaped bent over sections 11 and 12 forming the recessed profile section 15 have respectively such a width, that the recessed profile section 15 extends at least over approximately one-third of the maximum tube cross-sectional widths and equally at least over approximately a third of the maximum tubular cross-sectional height.

Shelf boards 3 with the previously described, especially refined longitudinal edge-stiffening profiles can be utilized in a particularly advantageous manner for the construction of shelves, in which the shelf compartments formed in between the shelf boards 3, 3'', 3''' located one above the other are intended to or must be subdivided by means of vertical partitions 4 and 5. So that the partitions 4 and 5 can be securely inserted into the shelf compartments, each of the shelf boards 3 comprises on the one side in the shelf board face 8 detent slits and/or holes 16 and on the other side corresponding detent slits and/or holes 17 in the longitudinal edge-stiffening profiles 6. The detent slits and/or holes 16 and 17 are here respectively in a registering position one above the other and are at the same time arranged uniformly distributed along the longitudinal edges of the shelf board 3 in the form of a detent.

A particular feature of the shelf boards 3 with the previously described development of the longitudinal edge-stiffening profiles 6 lies in that the detent slit and/or holes in the shelf board face 8 and the longitudinal edge/stiffening profile 6 located underneath lie in an area, which at least partially overlaps into the step-shaped bent over sections 10, 11 and 12 of the profile constriction 15, as can be clearly seen in FIG. 2. Hereby it has been shown to be particularly advantageous if the detent slit and/or holes 17 extend in the longitudinal edge-stiffening profile 6 respectively over an approximately Z-shaped profile area, which is determined by a portion of the bent over section 10, by a portion of the bent over section 12, and of the entire bent over section 11. Thereby it is achieved that the detent slits and/or holes 17 lie in at least two insertion surfaces located one above the other in the longitudinal section-stiffening profile 6, while the remaining detent slits and/or holes 16 are located in a third insertion surface.

The partitions 4 and 5 respectively work together with the detent slits and/or holes 16 and 17 in the shelf boards 3 by means of special detent blades, lugs and/or pins, whereby the detent blades, lugs and/or pins 18 located at the bottom edge of a partition 4 or 5 are shown in FIG. 2 at the partition 5. The partition 4 comprises corresponding detent blades, lugs and/or pins 18 at its bottom edge.

The partition 4 is, in contrast to partition 5, provided also at its upper edge with detent blades, lugs and/or pins 19, as the FIG. 2 makes clear.

Figure 3:
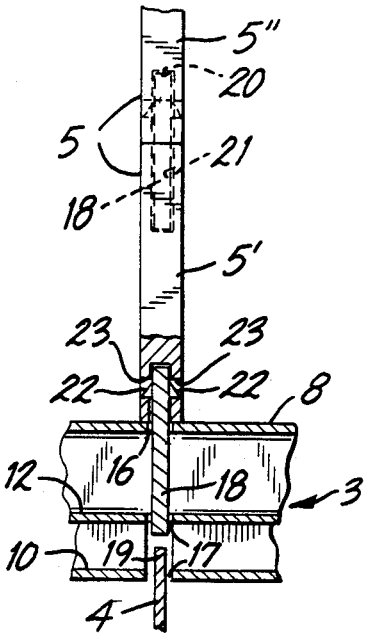
FIG. 3 is a sectional view along the line III—III in FIG. 2.

An important criterion lies therein, that the detent blades, lugs and/or pins 18, located at the bottom edge of a partition 4 or 5 and in particular at the bottom edge of the partition, have such a length dimension, that they not only can extend through the detent slits and/or holes 16 in the shelf board face 8, but rather reach with their free ends also into the insertion face of the detent slits and/or holes 17 which is determined by the bent over section 12 of the longitudinal edge-stiffening profile 6. It is, however, also equally important that the free length of the detent blades, lugs and/or pins 18 at the bottom edge of the partitions 4 and 5 is dimensioned to be smaller than the maximum cross-sectional height of the longitudinal edge-stiffening profile 6, in order that they cannot reach as far as the insertion face of the detent slits and/or holes 17, determined by the bent over section 10 of the longitudinal edge-stiffening profile 9. They must rather at the latest end at the level located at half the height of the bent over section 11 of the longitudinal edge-stiffening profile 9 located in between the two insertion faces, as can be gathered from FIGS. 2 and 3.

The insertion engagement of the detent blades, lugs and/or pins 5 provided at the bottom edges of the partitions 4 and 5 into two insertion faces spaced above each other is particularly important for such partitions 5, which are built into the shelf compartments as so-called dividers, which therefore do not find any support with their upper boundary edges at the shelf board 3''' located above, as can be seen in FIG. 1. On the other hand it is also important that the detent blades, lugs and/or pins 18 located at the bottom edges of the dividers 4 and 5 do not obstruct the engagements of detent blades, lugs and/or pins 19 into the lower insertion face of the detent slits and/or holes 17, in case partitions 4 must be attached at the same place, which comprise the detent blades, lugs and/or pins 19 at the upper boundary edge, as is learned equally from FIGS. 2 and 3.

The detent blades, lugs and/or pins 18 provided at the bottom edge of the partitions 4 and 5 and the detent blades, lugs and/or pins 19 provided at the upper edge of the partitions 4 can be, in deviation from the arrangement illustrated in FIG. 2, also arranged staggered sideways so far with respect to each other, that they come to lie next to each other within the detent slits and/or holes of the longitudinal edge-stiffening profile 6. The detent blades, lugs and/or pins 18 can thereby lie in the area of the upper insertion face of the detent slits and/or holes 17, while the detent blades, lugs and/or pins are located only in the area of the lower insertion face of the detent slits and/or holes 17. In this case it would then be conceivable, not to pierce the bent over section 11 of the longitudinal edge-stiffening profile 9, rather to leave it as a guiding bar in between the upper and the lower horizontal section of the detent slits and/or hole 17.

It is additionally worth mentioning that the partitions 4, which are provided with detent blades, lugs and/or pins 18 and 19 not only at the lower edge but also at their upper edge, can be fabricated as laminated member-punched parts, for instance from hard synthetic material or sheet metal. On the other hand it is, however, advantageous, to assemble the partitions 5 from several identical or equally constructed partition-partial pieces 5' and 5'' as a relatively thick injection molding parts from a synthetic material. In this case namely pockets 20 emanating from the bottom edges and pockets 21 emanating from the upper edges can be molded in, which act together with detent blades, lugs and/or pins. The detent blades, lugs and/or pins 18 manufactured as independent molded parts for instance from synthetic material, can then be inserted into the pockets 20 by means of barbed hook-shaped detent blades 22 in a positively locked way, which hooks spring into window-shaped cutouts. On the other hand the pockets 21 make it possible to accept the free length part pieces of the detent blades, lugs and/or pins 18 of a to-be-inserted partition-partial piece 5'', as can be learned from FIGS. 2 and 3. By insertion of several equally constructed or identical partition-partial pieces 5' and 5'' the partitions 5 which are usable as so-called dividers can be adapted to the diverse intermediate heights of the shelf compartments.

It can additionally be learned from FIG. 2, that the individual partition-partial pieces 5' and 5'' can be provided with an insertion guide 24 open towards the upper edge of said partitions, into which in case of necessity marking carriers 25, for instance labels can be inserted.

I claim:

1. Shelf board formed from plate-like material, such as sheet metal, comprising a generally horizontal plate-like support member having a pair of longitudinal edges and a pair of transverse edges extending transversely of and between the longitudinal edges, said support member arranged to be supported horizontally and having an upper face and a lower face, said support member having a first stiffening profile extending along downwardly and inwardly from each said longitudinal edge and a second stiffening profile extending along and downwardly from each said transverse edge, at least one of said first stiffening profiles forms in combination with said lower face of said support member a closed tubular section extending along and inwardly from at least one said longitudinal edge, said second stiffening profile extending downwardly from said transverse edge and having an angularly shaped section, said at least one first stiffening profile having a first side section extending generally vertically downwardly from one of longitudinal edges of said support surface, a bottom section spaced downwardly from said lower face of said support member and extending generally horizontally inwardly from said first side section located aligned below said support member, and a second side section spaced inwardly from said first side section and extending upwardly from said bottom section to said lower face of said support member whereby the combination of said lower face of said support member, said first and second side sections and said bottom section form the closed tubular section, and said bottom section and second side section form a step-like recessed profile section transverse to said longitudinal edge spaced downwardly from said lower face of said support member so that the step-like recessed profile section is spaced inwardly from said generally vertical first side section.

2. Shelf board, as set forth in claim 1, wherein said at least one first stiffening profile has a height extending in the direction downwardly from said support member and a width extending in the direction of said transverse edges, and said at least step-like recessed profile section has a height and a width extending for at least approximately one-third of the cross-section of said at least one said first stiffening profile.

3. Shelf board, as set forth in claim 1 or 2, including an arrangement of said shelf boards one above the other and forming a shelf compartment between adjacent said shelf boards, said shelf boards having openings in said support members and in said at least one first stiffening profile with said openings being in vertical alignment, vertically arranged partitions for dividing the shelf compartment transversely of the longitudinal edges, means on said partitions for insertion into said openings, and said opening in said at least one first stiffening profile being located in the region of the profile spaced inwardly from said first side section and containing said step-like recessed profile section.

4. Shelf board, as set forth in claim 3, wherein said step-like recessed profile section has a generally profile in section extending transversely of the longitudinal edges and said openings in said at least one first stiffening profile are located in the region of said Z-shaped profile section.

5. Shelf board, as forth in claim 3, wherein said means on said partitions for extending into said openings comprise vertically arranged members having a length in the vertical direction less than the corresponding vertical dimension of said at least one first stiffening profile below said support member.

6. Shelf board, as set forth in claim 5, wherein said vertical members on said partitions arranged to extend downwardly through said support member having a vertical dimension at least greater than the vertical dimension of said step-like recessed profile section downwardly from the lower face of said support member.

7. Shelf board, as set forth in claim 3, wherein at least certain of said vertical partitions can be assembled from vertical partition sections extending vertically one above the other and means for interconnecting said vertically extending partition sections.

8. Shelf board, as set forth in claim 7, wherein said partition sections are molded from a synthetic material, said vertical sections have pockets molded therein along the upper and lower surfaces thereof for receiving said means for interconnecting said partition sections.

* * * * *